US012778227B2

(12) United States Patent
Lambert et al.

(10) Patent No.: US 12,778,227 B2
(45) Date of Patent: Nov. 3, 2026

(54) MULTI-LAYER APPAREL AND ACCESSORY CONSTRUCTION FOR COOLING AND VENTILATION

(71) Applicant: MPUSA, LLC, Purchase, NY (US)

(72) Inventors: Thomas Lambert, Stamford, CT (US); Josh Shaw, Rye Brook, NY (US); David Chad Lawrence, Bay Minette, AL (US)

(73) Assignee: MPUSA, LLC, Purchase, NY (US)

( * ) Notice: Subject to any disclaimer, the term of this patent is extended or adjusted under 35 U.S.C. 154(b) by 366 days.

(21) Appl. No.: 18/607,717

(22) Filed: Mar. 18, 2024

(65) Prior Publication Data

US 2024/0215669 A1 Jul. 4, 2024

Related U.S. Application Data

(63) Continuation-in-part of application No. 17/627,897, filed as application No. PCT/US2020/041593 on Jul. 10, 2020.

(60) Provisional application No. 62/874,665, filed on Jul. 16, 2019.

(51) Int. Cl.

| | |
|---|---|
| ***A41D 27/28*** | (2006.01) |
| ***A41B 1/08*** | (2006.01) |
| ***A41D 27/08*** | (2006.01) |
| ***A42B 1/00*** | (2021.01) |

(52) U.S. Cl.

CPC ..... *A41D 27/28* (2013.01); *A41B 1/08* (2013.01); *A41D 27/08* (2013.01); *A42B 1/00* (2013.01); *D10B 2201/22* (2013.01); *D10B 2331/02* (2013.01); *D10B 2331/04* (2013.01); *D10B 2501/00* (2013.01); *D10B 2501/042* (2013.01)

(58) Field of Classification Search

None

See application file for complete search history.

(56) References Cited

U.S. PATENT DOCUMENTS

| | | | | |
|---|---|---|---|---|
| 5,515,543 | A | 5/1996 | Gioello | |
| 7,043,765 | B1 * | 5/2006 | Otsubo | A41B 1/00 2/129 |
| 8,133,824 | B2 | 3/2012 | Harber | |

(Continued)

FOREIGN PATENT DOCUMENTS

| | | | |
|---|---|---|---|
| CN | 102477660 | A | 5/2012 |
| CN | 206699407 | U * | 12/2017 |

(Continued)

OTHER PUBLICATIONS

English Machine Translation of CN 206699407U (Year: 2017).*

(Continued)

*Primary Examiner* — Jenna L Johnson

(74) *Attorney, Agent, or Firm* — KATTEN MUCHIN ROSENMAN LLP

(57) ABSTRACT

A cooling garment, and a method of construction thereof, includes: a first layer configured to be adjacent to a wearer's skin and comprising exemplary cooling fabrics capable of providing a conductive cooling effect when preferably when wet-activated; a second layer adjacent to the first layer and comprising a spacer material that allows for convective air flow; and a third layer adjacent to the second layer and comprising perforated holes in order to enhance the airflow to the first and second layers.

14 Claims, 11 Drawing Sheets

(56) References Cited

U.S. PATENT DOCUMENTS

| | | | | |
|---|---|---|---|---|
| 8,910,313 | B2 | 12/2014 | Gordon et al. | |
| 9,402,432 | B2 | 8/2016 | Dean | |
| 10,982,358 | B2 | 4/2021 | Alexander et al. | |
| 2003/0232560 | A1 | 12/2003 | Corner | |
| 2005/0086721 | A1 | 4/2005 | Lambertz | |
| 2005/0208266 | A1 | 9/2005 | Baron et al. | |
| 2006/0048263 | A1 | 3/2006 | Walsh | |
| 2009/0246485 | A1 | 10/2009 | Panse et al. | |
| 2009/0260126 | A1 | 10/2009 | Rock et al. | |
| 2012/0137411 | A1 | 6/2012 | Majoros | |
| 2013/0037248 | A1 | 2/2013 | Ackroyd et al. | |
| 2013/0061366 | A1 | 3/2013 | Pezzimenti | |
| 2014/0338091 | A1* | 11/2014 | Kenney | A41D 13/0015 2/69 |
| 2018/0228233 | A1 | 8/2018 | Rock et al. | |
| 2018/0271184 | A1 | 9/2018 | Shalev et al. | |
| 2018/0347084 | A1 | 12/2018 | Lawrence | |
| 2019/0249340 | A1 | 8/2019 | Lawrence | |
| 2019/0254361 | A1 | 8/2019 | Gorissen | |
| 2020/0232128 | A1 | 7/2020 | Lawrence | |
| 2020/0404996 | A1* | 12/2020 | Kelly | A42C 5/04 |
| 2022/0132960 | A1 | 5/2022 | Baron et al. | |
| 2022/0258450 | A1* | 8/2022 | Lawrence | D04B 21/08 |
| 2023/0000176 | A1* | 1/2023 | Du | A41D 1/04 |
| 2023/0404205 | A1 | 12/2023 | Roup et al. | |

FOREIGN PATENT DOCUMENTS

| | | | |
|---|---|---|---|
| EP | 3801095 | B1 | 9/2022 |
| JP | 6600969 | B2 | 11/2019 |
| KR | 102476955 | B1 | 12/2022 |
| WO | 03061412 | A2 | 7/2003 |
| WO | 2017210589 | A2 | 12/2017 |
| WO | 2019147997 | A1 | 8/2019 |
| WO | 2020154353 | A1 | 7/2020 |

OTHER PUBLICATIONS

Non-final Office Action dated Jul. 14, 2025, from U.S. Appl. No. 17/627,897, 13 sheets.

Final Office Action dated Mar. 6, 2025 from U.S. Appl. No. 17/627,897, 12 sheets.

International Search Report and Written Opinion mailed May 19, 2025, from PCT/US2025/015765, 14 sheets.

Huk, "Huk Icon X Long Sleeve", Oct. 1, 2023, https://web.archive.org/web/20231001113543/https:/www.hukgear.com/products/huk-icon-x-ls-white.

Nike, "Nike TechKnit", Men's Dri-Fit ADV Long-Sleeve Running Top, Mar. 25, 2023, https://web.archive.org/web/20230325050439/https:/www.nike.com/t/techknit-mens-dri-fit-adv-long-sleeve-running-top-bxx4XD/DV4194-010.

Gravity, "Jersey Gravity MTB", Spring Summer 2023, https://www.botteroski.com/en/116-cycling/117-cycling-clothing/118-cycling-shirt/466912-maglia-ciclismo-vr.html.

Fox Racing, "180 Kozmik Jersey", Oct. 9, 2023, https://www.foxracing.com/product/180-kozmik-jersey/30449.html?dwvar_30449_color=018&dwvar_30449_size=XS&cgid=motocrossjerseys-mens.

Lazy Ass Bikers, "Leatt Jersey Moto 5.5 Ultraweld Graphite (502303090)", Apr. 1, 2023, https://web.archive.org/web/20230401000000*/https:/www.lazyassbikers.com/products/leatt-jersey-moto-5-5-ultraweld-graphite-502303090.

Pactimo, "Women's Summit Shell Jacket", Jun. 3, 2023, https://web.archive.org/web/20230603014827/https:/www.pactimo.com/products/womens-cycling-jacket-summit-shell.

Pronature, ""EAG Elite" short sleeve fishing shirt-Men's", Apr. 10, 2020, https://www.ubuy.co.in/product/40R4PQ8VO-eag-elite-mossy-oak-short-sleeve-button-down-performance-fishing-shirt.

ASP Group Distribution, "Fox Wmns Flexair Mirer Jersey—S, Purple Haze MX22", Nov. 22, 2021, https://foxracing.co.uk/product/womens-flexair-mirer-jersey/28172.html.

International Search Report and Written Opinion mailed Oct. 16, 2020, from PCT/US2020/041593, 8 sheets.

International Preliminary Report and Written Opinion issued Jan. 18, 2022, from PCT/US2020/041593, 7 sheets.

Non-Final Rejection dated Jan. 29, 2024, from U.S. Appl. No. 17/627,897, 33 sheets.

Final Rejection dated Nov. 15, 2023, from U.S. Appl. No. 17/627,897, 27 sheets.

Non-Final Rejection dated May 23, 2023, from U.S. Appl. No. 17/627,897, 35 sheets.

* cited by examiner

MULTI-LAYER APPAREL AND ACCESSORY CONSTRUCTION FOR COOLING AND VENTILATION

CROSS-REFERENCE TO RELATED APPLICATION

This application is a continuation in part of U.S. patent application Ser. No. 17/627,897, filed Jan. 18, 2022, which is a national phase application of International Application PCT/US2020/041593, filed Jul. 10, 2020, which claims priority to U.S. Provisional Patent Application Ser. No. 62/874,665, filed on Jul. 16, 2019.

TECHNICAL FIELD

The present application relates to a multi-layer apparel and accessory construction for cooling and ventilation, e.g., a garment which provides cooling, and methods of construction thereof.

BACKGROUND

Users may wear athletic garments such as shirts, shorts, hat, headbands, etc. for a number of practical reasons. For example, an athletic shirt may keep the user cool during high-intensity activities and a head-covering garment can be used to provide necessary shade for the user. Further, the athletic garments may be partially or wholly formed from a wicking and/or absorbent material, e.g., to wick sweat away from the skin and to absorb sweat or other liquids. However, during particularly hot conditions, such as increased physical activity and/or as a result of external atmospheric conditions (e.g., warm/hot weather), many of the current athletic garments fail to provide adequate cooling for the wearer. Accordingly, there is a need for a solution which can overcome at least some of the deficiencies described herein.

SUMMARY

An exemplary garment, portion of a garment, or accessory includes a plurality of different materials that can provide an overall cooling effect. For example, a first layer (104) can be adjacent to a wearer's skin and can include cooling fabrics capable of providing a conductive cooling effect, e.g., when wet through evaporative cooling or, alternatively, in a dry state. Further, a second layer (106) can be adjacent to the first layer and can include a spacer material, which can allow for convective air flow, thereby aiding in the evaporation of liquid from the first layer as well as enhancing the conductive cooling of the skin adjacent to the first layer. Further, a third layer (108) can be adjacent to the second layer and can include perforated holes in order to enhance the airflow to the first and second layers. In addition, the third layer can correspond to the outer shell of the exemplary garment.

The evaporative cooling effect of material/construction 100 in FIGS. 1A and 1B is activated when the material/construction 100 is wetted, wringed, snapped and/or twirled in the air. The cooling effect for the material 100 described herein utilizes the principles of evaporative cooling (heat of evaporation). This principle states that water requires heat energy to change from a liquid into a vapor. In order for evaporation to occur, heat must be taken from the liquid water, which leaves cooler liquid in material 100.

Once material 100 is wetted and preferably wringed to remove excess water, snapping or twirling in the air is a recommended process as it helps facilitate and expedite the moisture movement from the inside layer 104 to the outside layers 106 and 108, where greater water evaporation to the environment occurs. Snapping or twirling in the air also increases the evaporation rate and decreases the material temperature more rapidly by exposing more surface area of material 100 to air and increasing airflow. More specifically, the material 100 works as a device that facilitates and expedites the evaporative process. The methods of making material 100 described herein provide additional benefits of cooling over alternative constructions. Once the temperature of the remaining water in the outer evaporative layers (e.g., sides 104 and 108) drops through evaporation, a heat exchange takes place within water through convection, between water and material 100 through conduction, and within material 100 through conduction. Thus, the temperature of material 100 drops. The evaporation process further continues by wicking water away from the inside to the outside layers until the stored water is used up. The evaporation rate decreases as the temperature of material drops. The temperature of material 100 drops gradually to a certain point where equilibrium is reached between the rate of heat absorption into material from the skin and heat release by evaporation.

Once the wetted material 100 is placed onto a user's skin 102, material 100 transfers heat through conduction from skin surface 102 to side 104. After the heat transfer has occurred, the temperature of material 100 increases to equilibrate with the temperature of skin surface 102. Once this occurs, the wetted material 100 can easily be reactivated by the snapping or the twirling method to again drop the temperature. As previously stated, the methods of making material 100 described herein provide additional benefits of cooling over other materials.

Material 100 can also be activated through the saturation of sweat. As a user sweats, the inside 104 absorbs the sweat or moisture from skin surface 102. The user can use material 100 in this manner until the textile has become completely saturated. Then, to reactivate material 100, it can be wringed and twirled in air to reactivate. The user's sweat can be used to activate material 100.

To help produce the unique cooling effect of material/construction 100, a first layer 104 includes either predominately polyester or nylon yarns with an optional modified cross-section yarn imbedded with cooling minerals (or particles), which act to transport and evaporate moisture while providing a cool touch. Example particles and/or include titanium dioxide, mica, jade, and graphene. The second layer 106 includes either predominately polyester or nylon yarn with spacer material which can allow for convective air flow, thereby aiding in the evaporation of liquid from the first layer as well as enhancing the conductive cooling of the skin adjacent to the first layer. The third layer 108 can include a plurality of vent pores (e.g., perforated holes) which provide convective cooling through ventilation and evaporation. The vent pores may be formed by laser perforations. The vent pores may have a number of different shapes and sizes including, but not limited to circles, squares, triangles or stars. The vent pores may be different or the same sizes ranging from 0.5 mm to 15 mm each. The vent pores may be arranged in a repeating pattern, a particular design (e.g., a logo), or in a non-repeating arrangement. The material used in the third layer can be synthetic fiber such as polyester or nylon so that this layer can be laser perforated which allows for greater breathability.

An exemplary garment, portion of a garment, or accessory includes: a first layer 104, in which the first layer 104 includes a plurality of synthetic filament yarn with a modified cross-section; a second layer 106, in which the second layer 106 includes another plurality of synthetic filament yarn in a mesh construction; and a third layer 108, in which the third layer includes a plurality of vent pores. The first layer 104 and second layer 104 may also comprise a plurality of vent pores.

The first layer 104 and/or the second layer 106 may be constructed with a circular knitting construction.

The first layer 104 and/or the second layer 106 may be constructed with a warp knitting construction.

The synthetic filament yarn may include polyester and/or nylon.

The plurality of synthetic filament yarn in the first layer may include: (i) 70%-100% of polyester or nylon and (ii) 0%-30% of spandex.

The first layer 104 may have (i) a cumulative heat flux of at least 5,000 $W/m^2$ and (ii) a Q-max rating of greater than 0.130 $W/cm^2$.

The first layer 104 may include embedded particles and/or embedded minerals.

At least one other synthetic filament yarn may cover the synthetic filament yarn.

The at least one other synthetic filament yarn may cover the synthetic filament yarn by a single-covered manner, a double-covered manner, and/or an air jet covering technique.

The synthetic filament yarn may be wrapped with the at least one other synthetic filament yarn and spun to create a single yarn.

A pile height of the synthetic filament yarn in the second layer may be at least 1 mm.

The first layer 104, the second layer 106, and third layer 108 may provide: cooling power that is 40% greater than normal garment constructions as measured by the modified ASTM Method F1868; instant cool touch as defined as Q-max≥0.130 when dry and ≥0.180 when wet; and when wet-activated, (i) wicking and absorbent ability allows for a temperature decrease of thirty degrees below body temperature and (ii) a duration of the cooling can extend to approximately two hours depending on external humidity/temperature conditions.

The second layer 106 may be arranged between the first layer 104 and the third layer 108. The second layer 106 may have a mesh construction.

A first side of the first layer 104 may be adapted to touch a wearer's skin, a second side of the first layer 104 may be arranged opposite a first side of the second layer 106, a second side of the second layer 106 may be arranged opposite a first side of the third layer 108, and a second side of the third layer 108 may be adapted to be exposed to the environment.

An exemplary garment, portion of a garment, or accessory, includes: a first layer 104, a second layer 106, and a third layer 108. The first layer 104 includes a single knit jersey construction weighing 190±20 gsm with a fiber content of 92%±5% polyester yarns and 8%±5% spandex yarns; the polyester yarns include a modified cross-section for increased capillary action and evaporative ability; the polyester yarns are embedded with particles for adding a cool touch effect as defined by Q-max≥0.130 when dry and Q-max≥0.180 when wet; and the polyester yarns include a yarn filament count of greater than 24 filaments per end of polyester yarn. The second layer 106 includes another plurality of synthetic filament yarn including spacer material in a mesh construction, in which: the spacer material includes a breathability of greater than 800 MVTR; the spacer fabric is between 100 gsm and 500 gsm; a pile height of the spacer material is at least one millimeter; and the spacer material is infused with cooling yarns including aqua-X, mipan XF or askin. The third layer 108 includes a plurality of perforated holes, in which the third layer 108 includes a rip stop material weighing less than 150 grams per square meter (gsm) and polyester or nylon.

An exemplary garment, portion of a garment, or accessory includes: a first layer 104 including at least 80% polyester yarns with modified cross-section yarn imbedded with cooling minerals, the cooling materials being titanium dioxide, mica, jade, and/or graphene; a second layer 106 including at least 80% nylon yarns with spacer material which allows for convective air flow and weighs between 100 gsm and 500 gsm; and a third layer 108 including polyester yarns and a plurality of vent pores, the third layer weighing less than 150 grams per square meter.

DETAILED DESCRIPTION OF EMBODIMENTS

The following description of embodiments provides non-limiting representative examples referencing numerals to particularly describe features and teachings of different aspects hereof. The embodiments described should be recognized as capable of implementation separately, or in combination, with other embodiments from the description of the embodiments. A person of ordinary skill in the art reviewing the description of embodiments should be able to learn and understand the different described aspects of this disclosure. The description of embodiments should facilitate understanding of these embodiments to such an extent that other implementations, not specifically covered but within the knowledge of a person of skill in the art having read this description, would be understood to be consistent with an application of these embodiments.

Figure 1A:
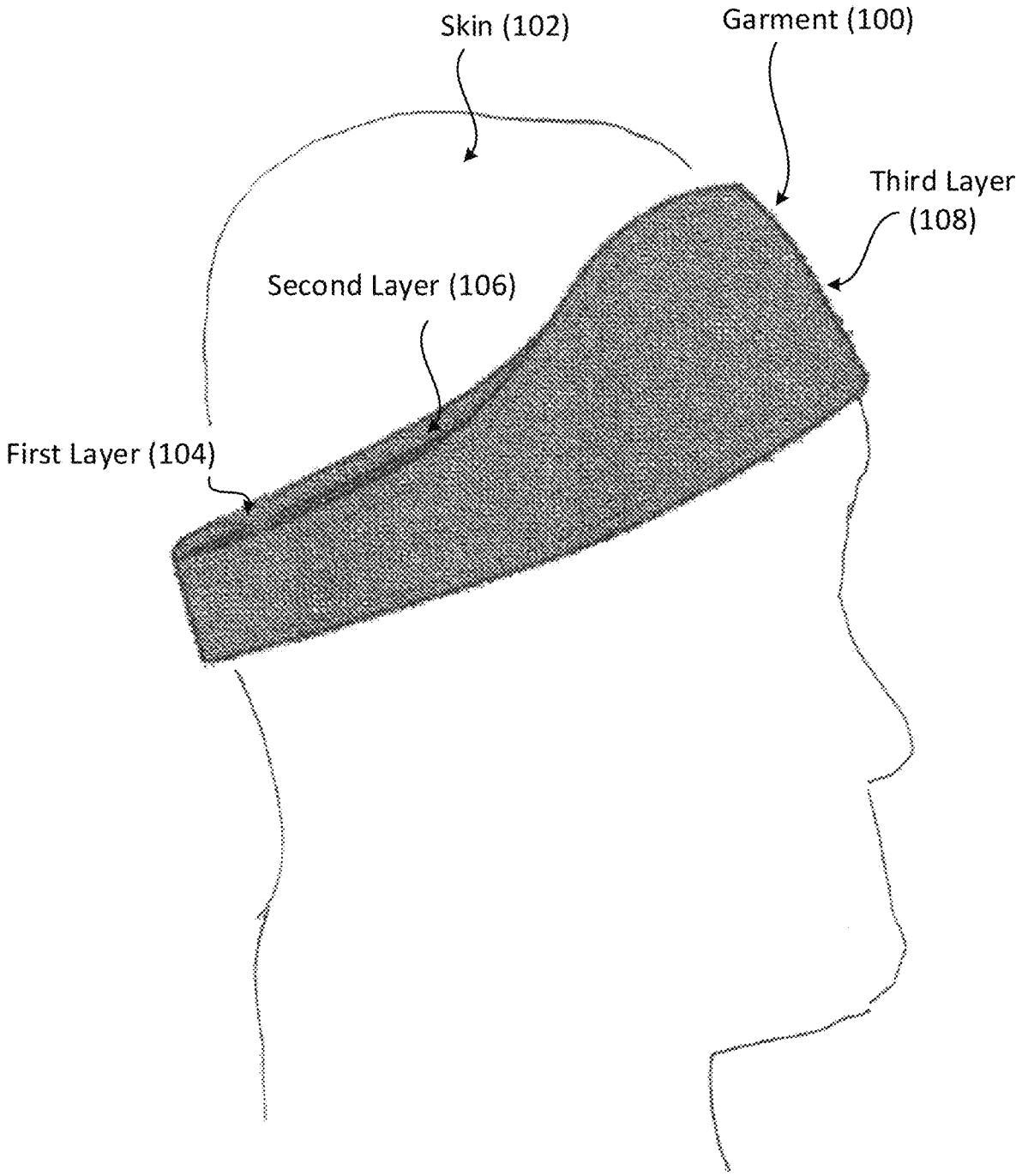
FIG. 1A illustrates an exemplary garment.
Figure 1B:
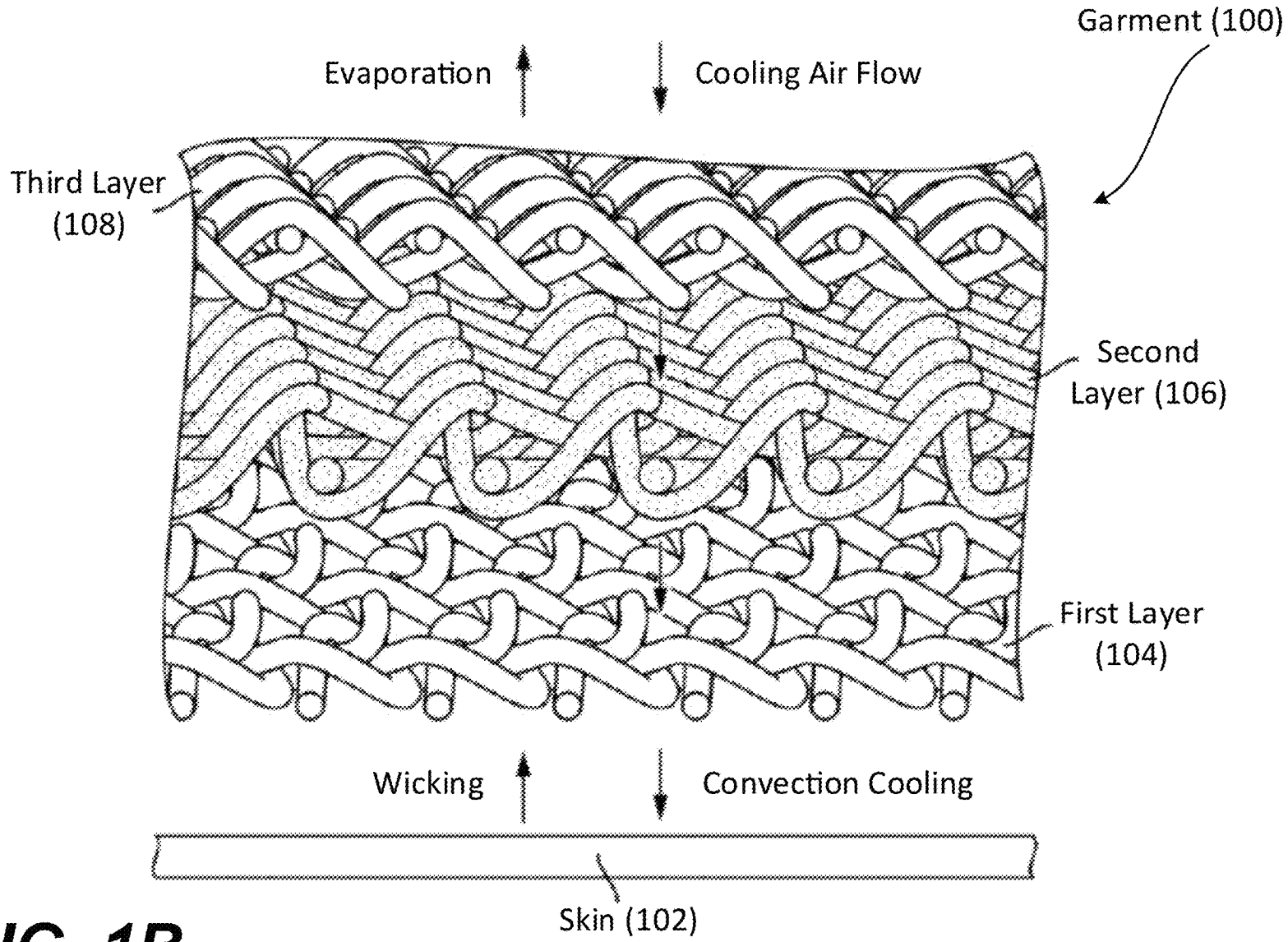
FIG. 1B illustrates layers of an exemplary garment.

FIG. 1A illustrates an exemplary garment. As depicted in the FIG. 1A, exemplary garment 100 can be a headband. However, in other embodiments, the exemplary garment can be a shirt, a pair of shorts, a towel, a hat, etc. According to an embodiment, the exemplary garment 100 can include a first layer 104, a second layer 106, and a third layer 108, which are depicted in more detail in FIG. 1B.

According to an embodiment, the first layer 104 can be adjacent to the skin 102 of a particular user. Further, the first layer 104 can include synthetic yarn. For example, the first layer 104 can include modified cross-section synthetic filament yarn to aid in the moisture transport and evaporation. The modified cross-section can be a cross-section other than round which can include but not limited to: trilobal, rectangular, dog-bone, or in cloud shapes. In general, modified cross-sections in yarn can increase the spread of moisture which increases the surface area spread and the evaporative effect of the yarn over non-modified (rounded) cross-section yarn. These yarns can also contain embedded cooling particles (e.g., titanium dioxide, jade, mica, and/or graphene) to increase the Q-max rating (instant cool touch) of the first layer 104. In this regard, the Q-max can be greater than 0.130 W/cm$^2$. Further, the cumulative cooling power of the first layer 104 can exceed a heat flux of 5,000 W/m$^2$ (watts per square meter) based on a modified version of the ASTM F1868 entitled "Standard Test Method for Thermal and Evaporative Resistance of Clothing Materials Using a Sweating Hot Plate." Further, the weight range of the first layer 104 can be between 20 gsm (grams per square meter) to 500 gsm.

According to an embodiment, the first layer 104 can include a single knit jersey construction weighing approximately 190 gsm with a fiber content of approximately 92% polyester and 8% spandex. According to another embodiment, the fiber content can range from 70%-100% polyester or nylon and 0%-30% spandex. In this regard, the corresponding yarns can be evaporative polyester and can include (i) a modified cross-section for increased capillary action and evaporative ability and (ii) embedded particles/minerals for adding a cool touch (e.g., Q-max) effect. Further, the first layer 104 can include a yarn filament count of greater than 24 filaments per end of polyester or nylon yarn used.

Figure 2A:
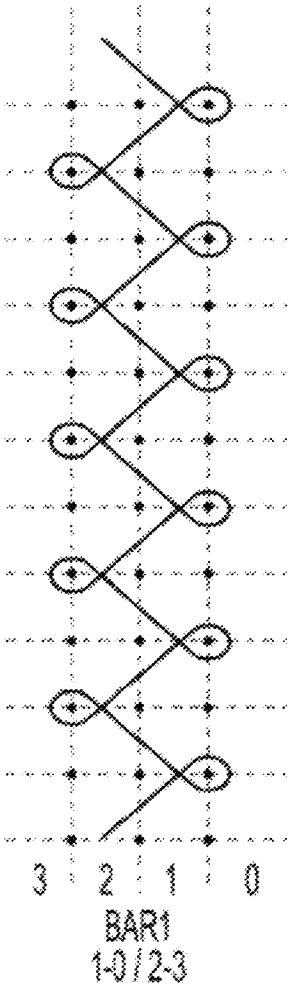
FIGS. 2A-2E illustrate exemplary warp knit constructions.
Figure 2B:
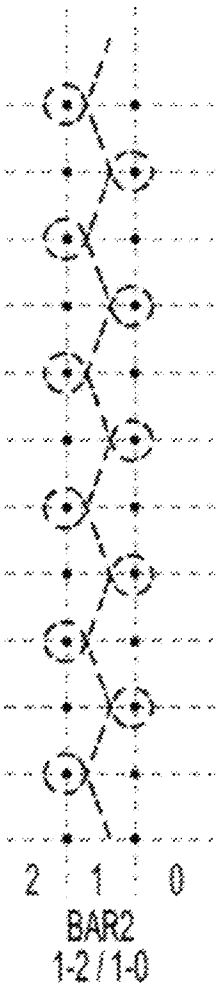
Figure 2C:
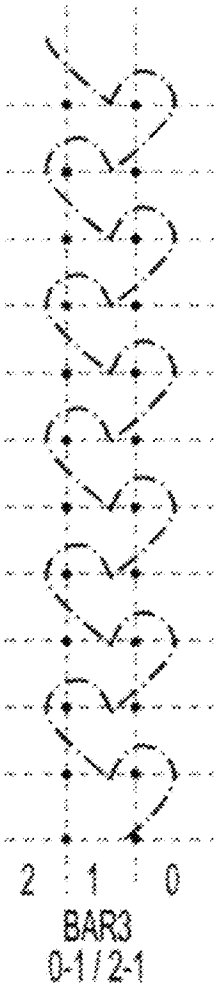
Figure 2D:
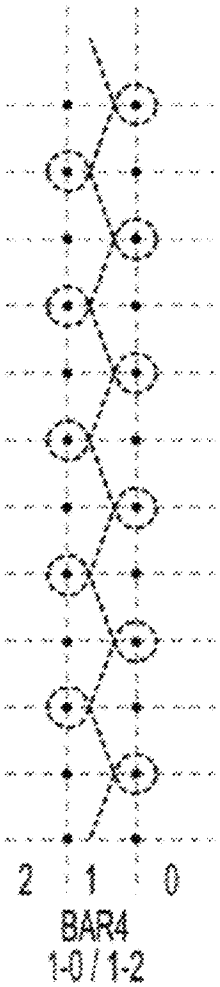

Further, according to another embodiment, the first layer 104 can be constructed using a warp knitting method. Warp knits include, but are not limited to, tricot, raschel, spacer, and lace. A first example for warp knit tricot 4-bar construction, depicted in FIGS. 2A-2E, utilizes the following stitch and yarn combinations: FIG. 2A—Bar 1—1-0/2-3 (evaporative yarn such as aqua-X); FIG. 2B—Bar 2—1-2/1-0 (absorbent yarn such as mipan XF); FIG. 2C—Bar 3—0-1/2-1 (evaporative yarn such as askin); and FIG. 2D—Bar 4—1-0/1-2 (elastic yarn such as spandex). According to an embodiment, bar 1 is a 35 Denier/24 filament nylon fully drawn yarn or draw textured yarn; bar 2 is a 50 Denier/48 filament conjugated polyester/nylon bi-component fully drawn yarn; bar 3 is a 75 Denier/36 filament polyester draw textured yarn; and bar 4 is a 40 Denier spandex.

Figure 2E:
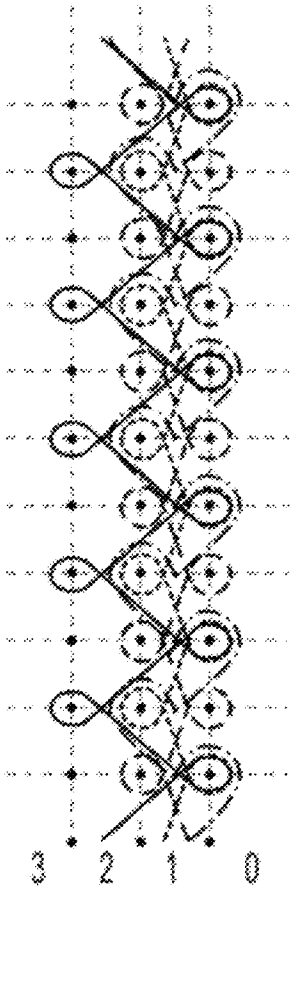

This configuration results in a fabric having a density of 100-600 gsm, e.g., 160-400 gsm. The combined first layer 104 resulting from this stitch is depicted in FIG. 2E. Further, The yarn Deniers and filament counts used on bars 1-4 can be varied using the following ranges: bar 1: evaporative yarn with Denier range—10 Denier-200 Denier, filament range—1 filament-400 filaments; bar 2: absorbent yarn with denier range—10 Denier-200 Denier, filament range—1 filament-400 filaments; bar 3: evaporative yarn with Denier range—10 Denier-200 Denier, filament range—1 filament-400 filaments; and bar 4: elastomeric yarn with Denier range—10 Denier-340 Denier. As another example, bar 2 may utilize a yarn such as Nanofront polyester yarn manufactured by Teijin which has significantly smaller filaments than traditional absorbent yarns. Another embodiment of the first layer 104 can use the following 4-bar knitting stitch and yarn combination: bar 1—1-0/2-3 (evaporative yarn such as askin); bar 2—1-2/1-0 (absorbent yarn such as Hyosung mipan XF); bar 3—0-1/2-1 (evaporative yarn such as askin); and bar 4—1-0/1-2 (clastic yarn such as spandex). In this stitch configuration, bar 1 is a 45 Denier/24 filament polyester fully drawn yarn; bar 2 is a 50 Denier/48 filament polyester and nylon conjugated fully drawn yarn; bar 3 is a 75 Denier/36 filament polyester draw textured yarn; and bar 4 is a 40 Denier spandex. In both knitting stitch examples, bars 1 and 3 are cool touch/quick dry/absorption materials as have already been described. The Q-max for these yarns is greater than 0.140 W/cm$^2$ on the face side and 0.120 W/cm$^2$ on the back side of the material which indicates a cooling touch effect as has already been described. The wet Q-max for these yarns is greater than 0.280 W/cm$^2$ on face side and 0.180 W/cm$^2$ on back side. Bar 2 is a conjugated highly absorbent yarn (mipan XF) which has a wicking rate and a wicking distance more than twice that of cotton of equivalent density. The spandex yarn provides hydrophobic properties, provides stretch properties, and a draping effect. Further, according to an embodiment, the warp knit patterns described with respect to FIGS. 2A-2E can be modified. For example, in FIG. 2A, bar 1-0/2-3 can be modified to 1/0-3/4.

Further, the first layer 104 can also be constructed using a warp knit spacer. A warp knit spacer machine can insert additional yarns such as a mono-filament yarn to provided added thickness to the first layer 104. This added thickness created by yarns such as mono-filament yarns can be substituted or combined intermittently with conjugate yarn while the outside yarns used can be highly evaporative yarns or other yarns. Further, the first layer 104 can also be constructed using a warp knit jacquard. A warp knit jacquard can be utilized to create unique patterns such as but not limited to lace, fancy knits, mesh, body mapped, and other three-dimensional designs. Warp knit jacquard can creatively place highly evaporative yarns with highly absorbent yarns within the same construction to create a uniquely designed cooling fabric with or without patterns such as mesh and graphics.

Further, the first layer 104 can be constructed using a spacer implementing a circular knitting method. For example, the first layer 104 can be constructed using a circular knit spacer machine. A circular knit spacer machine can insert additional yarns such as a mono-filament yarn to provided added thickness to the material of the first layer 104. This added thickness created by yarns such as mono-filament yarn can be substituted or combined intermittently with conjugate yarn while the outside yarns can be highly evaporative yarns or any other yarns. Further, the first layer 104 can also be achieved using a circular knit interlock, ponte, or pique constructions. A circular knit interlock machine can insert additional evaporative and absorbent yarns to provide added evaporative cooling ability to the fabric. The first layer 104 can also be achieved using a circular knit jacquard. A circular knit jacquard can be utilized to create unique patterns, such as, but not limited to, fancy knits, mesh, body-mapped patterns, and other three-dimensional designs. Circular knit jacquard can creatively place highly evaporative yarns with highly absorbent yarns within the same construction to create a uniquely designed cooling fabric with or without patterns such as mesh and graphics.

Figure 3:
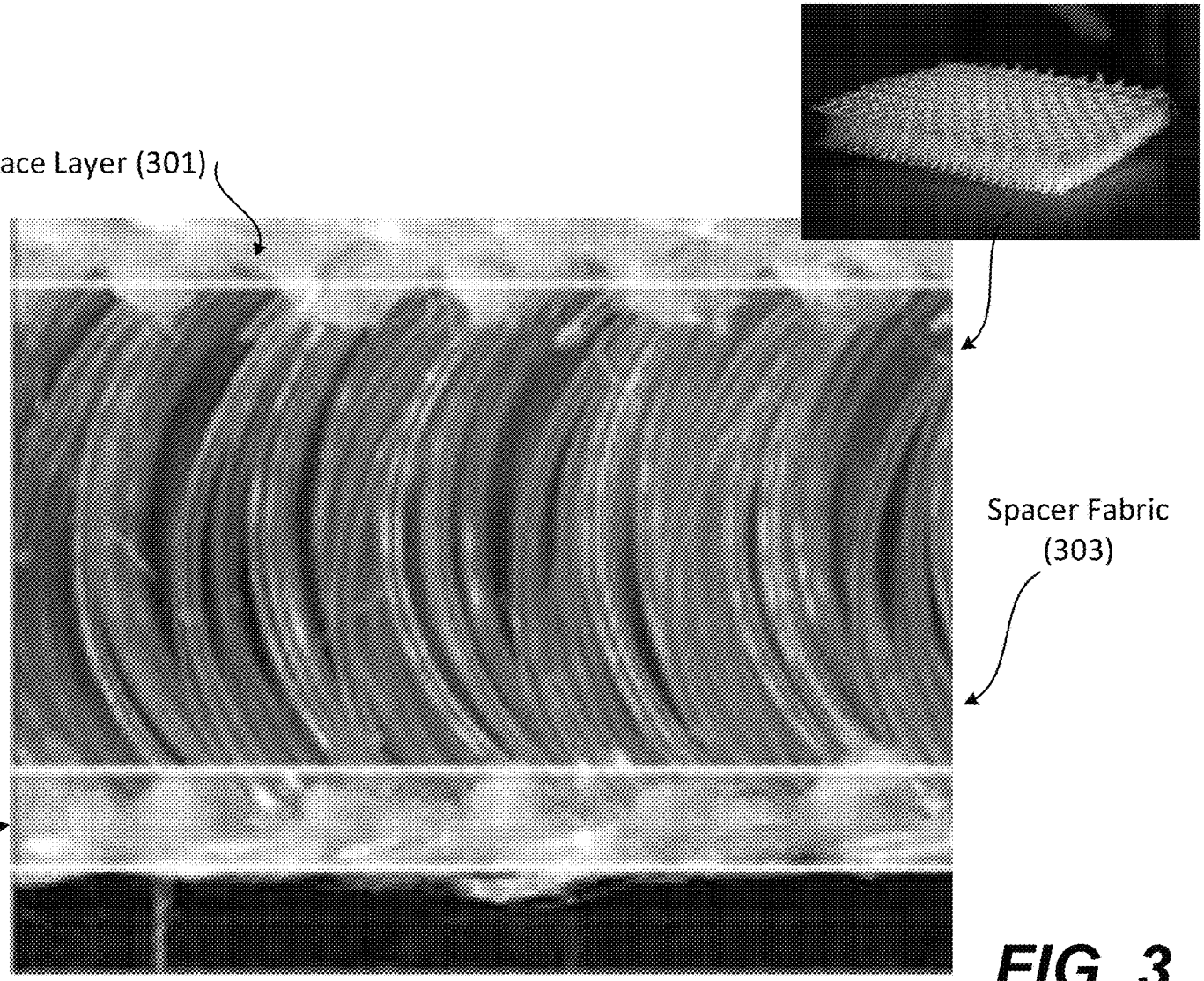
FIG. 3 illustrates a second layer of an exemplary garment.
Figure 4B:
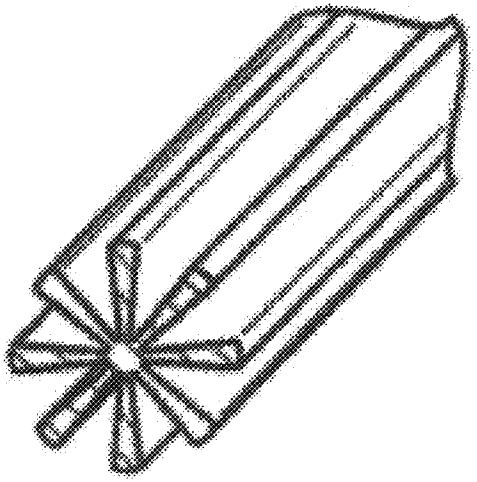
FIGS. 4A-4C illustrate cross-sectional views of synthetic filament yarns.
Figure 4A:
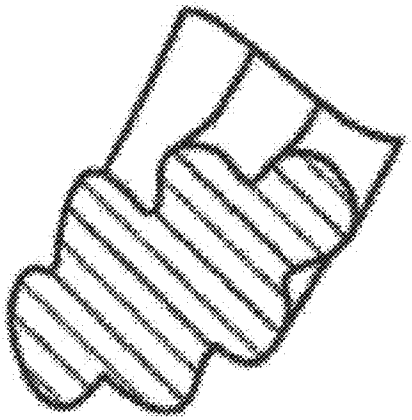

According to an example embodiment, the second layer 106 can include a spacer fabric construction, as depicted in FIG. 3. In this example, the second layer 106 can include a top surface layer 301, a bottom surface layer 302 and spacer fabric 303. The spacer fabric 303 in the second layer 106 can include a breathability (as tested by ASTM E96) of greater than 800 MVTR (e.g., moisture vapor transfer rate) within twenty-four hours. The spacer fabric can be knitted using a mesh construction at least on one side (e.g., top surface layer 301 or bottom surface layer 302) of the second layer 106 in order to allow for air pockets and greater air flow. Further, the weight range for the spacer fabric can be between 100 gsm and 500 gsm. Further, the pile height of the spacer fabric can be at least one millimeter (mm). Further, the spacer fabric can also be infused with cooling yarns which allow for greater evaporation and cool touch over other materials. The yarns used can be an inner evaporative nylon yarn such as aqua-X, a middle absorbent bi-component nylon/polyester yarn such as mipan XF) and an outer evaporative polyester yarn such as askin. Exemplary yarns which can be used as spacer fabric are depicted in FIGS. 4A and 4B. Further, according to an embodiment, the spacer fabric can be constructed using one of the circular knitting method or warp knitting method described above.

According to an example embodiment, layers 104 and 106 can comprise of a Dual Function Absorbing and Cooling Textile as described, for example, in PCT/US19/15239, which is expressly incorporated herein in its entirety by reference thereto. For example, the dual function ability of this textile can replace both layers 104 and 106. This Dual Function Absorbing and Cooling textile is a warp knit spacer textile that provides a dual function two-sided textile capable of absorbing up to four times its weight in perspiration on a loop absorbent side. Also, while wetted to activate, the same textile can provide increased conductive cooling on a non-loop (flat) absorbent side. More particularly, the multi-layer warp knit spacer fabric construction provides the ability to absorb sweat efficiently away from the skin while the same textile can be used to cool the skin to below a current temperature of the skin for a longer duration, primarily when wetted, but secondarily in dry state. Described in PCT/US19/15239 is an integrally formed warp knitted spacer structure that includes four bars of yarn which collectively work together to produce the textile.

According to an embodiment, the third layer 108 can correspond to the outer shell of the garment 100 and can include a plurality of vent pores (perforated holes) which can provide convective cooling through ventilation and evaporation. The material used in the third layer can be a rip stop material weighing less than 150 grams per square meter (gsm) and includes, for example, synthetic fiber such as polyester or nylon so that this layer can be laser perforated which allows for greater breathability. The weight range of this third layer material can be anywhere from 10 gsm to 400 gsm. It can also be constructed using any woven pattern or knit pattern material within the weight range of 10 gsm to 400 gsm. This material allows for ventilation to the inner hat band layer either by high breathability, through perforations, or other mechanisms.

In some embodiments, the third layer 108 comprise a plurality of vent pores or perforations to assist with evaporation and wicking. The pores may have different or the same sizes ranging from 0.5 mm to 15 mm each. The vent pores may be arranged in a repeating pattern, a particular design (e.g., a logo), or non-repeating arrangement. The vent pores may be formed by laser perforations or other known techniques. The vent pores may have a number of different shapes and sizes including, but not limited to circles, squares, triangles or stars. The vent pores may be different or the same sizes ranging from 0.5 mm to 15 mm each. In some embodiments, the first layer 104 and second layer 106 may also comprise vent pores in a similar or different arrangement as that of the third layer 108.

Figure 4C:
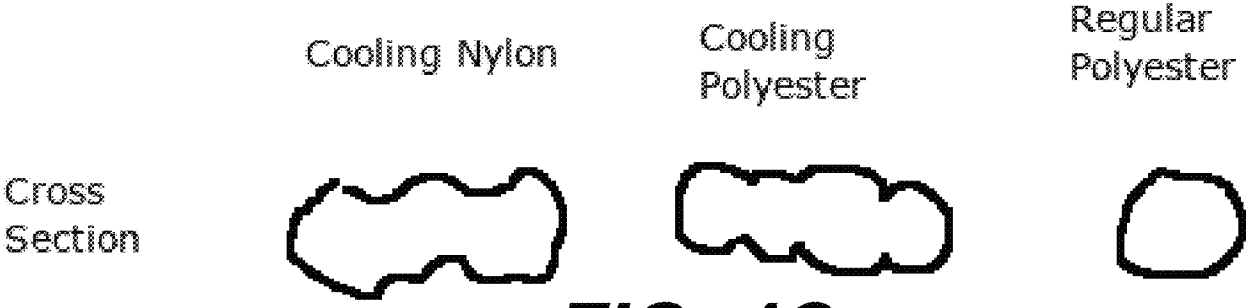

FIGS. 4A-4B illustrate cross-sectional views of synthetic filament yarns according to exemplary embodiments. For example, FIG. 4A depicts a synthetic filament yarn (e.g., polyester and/or nylon) having a unique cross section. According to an embodiment, the unique cross section creates channels in the yarn for moisture to move and evaporate more quickly. Furthermore, this unique yarn allows for better evaporation and therefore provides greater evaporative cooling for the described embodiments. Further, FIG. 4B depicts a synthetic filament yarn having a star-shaped cross section. In this regard, the star-shaped cross section provides a higher absorbency, and therefore, holds water more efficiently. This unique yarn can provide greater liquid absorption for the materials used herein, which can be used in combination with evaporative yarns to provide a longer evaporative cooling effect. According to an embodiment, a differentiated cross section helps moisture move and spread to the outer layer of the fabric. Further, the synthetic filament yarn can also include absorbent microdenier yarn. According to an embodiment, the absorbent microdenier yarn can be less than 1 denier per filament (dpf). Further, the absorbent microfiber yarn can use multiple filaments (e.g., 72 filaments) to provide absorbent properties. Further, according to another embodiment, conjugated bi-component special cross-section yarn can be used to provide extreme absorbent properties. Further, by splitting the yarn, more surface area, and therefore, more pockets can be created for absorbency. Further, FIG. 4C depicts the cross-sections of cooling nylon, cooling polyester, and regular polyester.

Figure 5A:
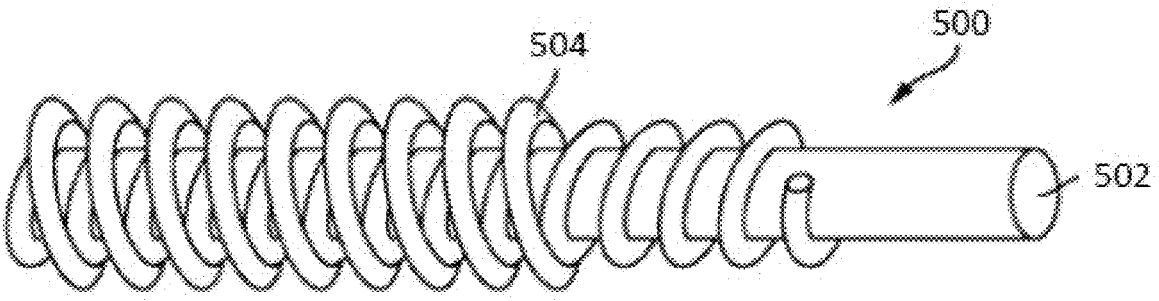
FIGS. 5A-5D illustrate exemplary covered synthetic filament yarns.
Figure 5B:
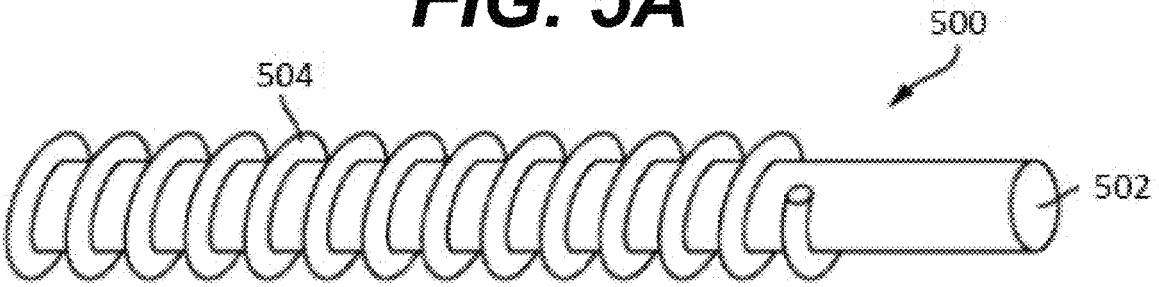
Figure 5C:
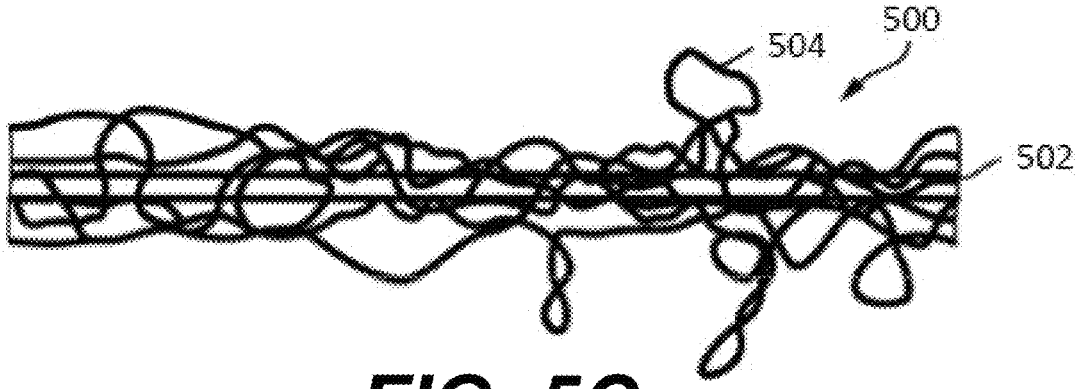
Figure 5D:
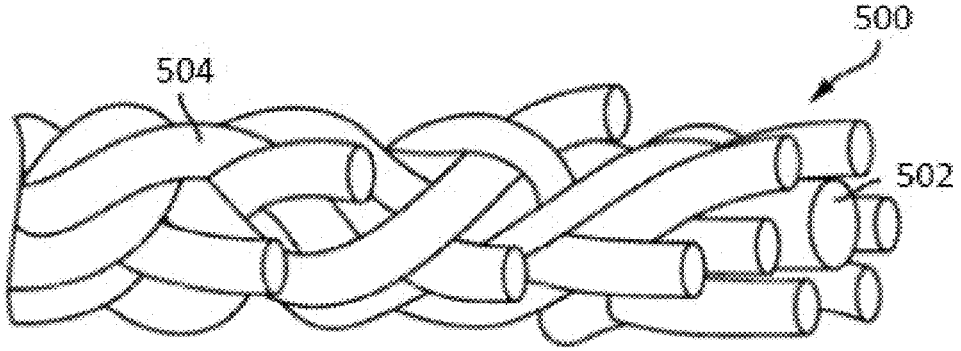

FIGS. 5A-5D illustrates exemplary covered synthetic filament yarn. For example, FIG. 5A illustrates a double-covered synthetic filament yarn. In particular, FIG. 5A depicts a covered synthetic filament yarn 500 including a core predominately synthetic spun or filament yarn 502 being covered by another synthetic filament yarn 504 in a double-covered manner. FIG. 5B illustrates a single-covered synthetic filament yarn. In this regard, FIG. 5B depicts the core predominately synthetic spun or filament yarn 502 being covered by another synthetic filament yarn 504 in a single-covered manner. Further, FIG. 5C illustrates an air jet-covered synthetic filament yarn. In this regard, FIG. 5B depicts the core predominately synthetic spun or filament yarn 502 being covered by another synthetic filament yarn 504 via air jet covering technique. Lastly, FIG. 5D illustrates a core-spun synthetic filament yarn. In this regard, the core predominately synthetic spun or filament yarn 502 is wrapped with other synthetic filament yarn 504 and spun into a single yarn 500. The list in Table 1 below describes possible combinations of a core synthetic filament yarn 502 and another synthetic filament yarn 504.

TABLE 1

| Core Yarn | Covered Yarn | Total Estimated Denier |
|---|---|---|
| 30 Ne 80% Polyester/20% Tencel Spun Yarn Blend | Synthetic Filament Evaporative Cooling Polyester 150 Denier/72 Filaments Draw Textured Yarn (DTY) | 327 Denier Total (Single covered) |
| 30 Ne 80% Polyester/20% Tencel Spun Yarn Blend | Synthetic Filament Evaporative Cooling Polyester 2 ply/70 Denier/26 Filament Fully Drawn Yarn (FDY) | 317 Denier total (Single covered yarn) |
| 30 Ne 80% Polyester/20% Tencel Spun Yarn Blend | Synthetic Filament Evaporative Cooling Nylon 140 Denier/136 Filament Draw Textured Yarn (DTY) | 317 Denier total (Single covered yarn) |
| 30 Ne 80% Polyester/20% Tencel Spun Yarn Blend | Synthetic Filament Evaporative Cooling Nylon 2 ply/70 Denier/48 Filament Fully Drawn Yarn (FDY) | 317 Denier total (Single covered yarn) |

Figure 6:
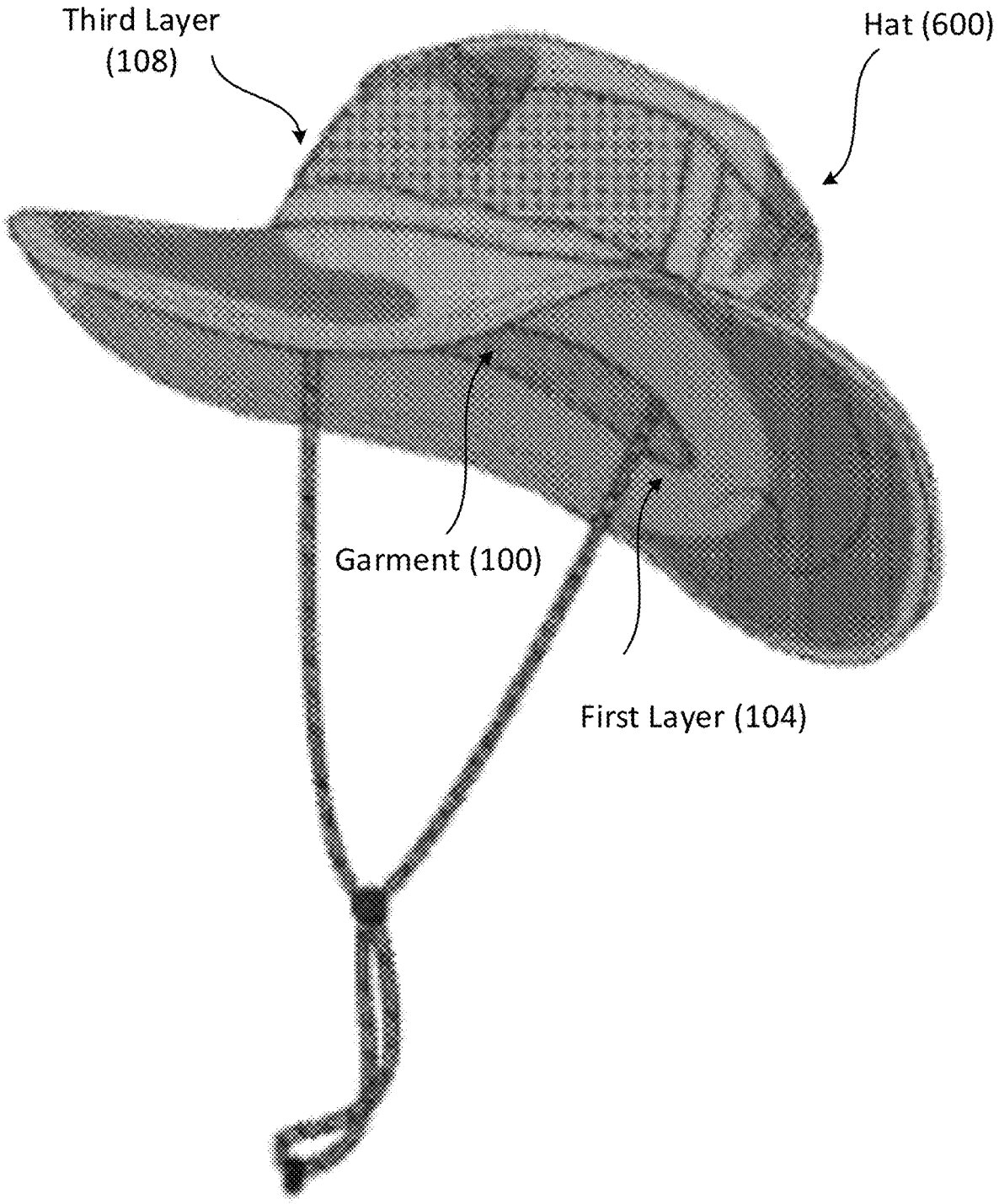
FIG. 6 illustrates an exemplary head-covering garment.

FIG. 6 illustrates an exemplary garment. In particular, FIG. 6 depicts the exemplary garment 100 as a hat 500. In this example embodiment, the hat 600 can include the garment 100 including the first, second and third layers 104, 106 and 108. The first layer 104 and the third layer 108 are displayed in the FIG. 6.

According to an embodiment, the exemplary garment 100 can provide the following advantages: cooling power that is 40% greater than normal garment constructions as measured by the modified ASTM Method F1868; instant "cool touch" as defined as Q-max≥0.130 when dry and ≥0.180 when wet; increased air ventilation and breathability, which helps enhance conductive and convective cooling; and, when wet-activated, (i) the wicking and absorbent ability allows for a temperature decrease of thirty degrees below body temperature and (ii) the duration of the cooling can extend to approximately two hours depending on external humidity/temperature conditions.

The garment as described herein may form a portion of a sun protection device, such as that described in U.S. Pat. No. 9,402,432, which is expressly incorporated herein in its entirety by reference thereto. In particular, a drape (or other portion) of such a sun protection device may be formed of the garment described herein. Moreover, the drape (or other portion) of such a sun protection device may be formed of the textile described in PCT/US19/15239, the textile and/or fabric described in U.S. patent application Ser. No. 16/077,353, the fabric described in U.S. patent application Ser. No. 16/100,939, the fabric described in U.S. patent application Ser. No. 16/749,016, and/or the fabric described in PCT/US2020/014529, each of which is expressly incorporated herein in its entirety by reference thereto.

Figure 7A:
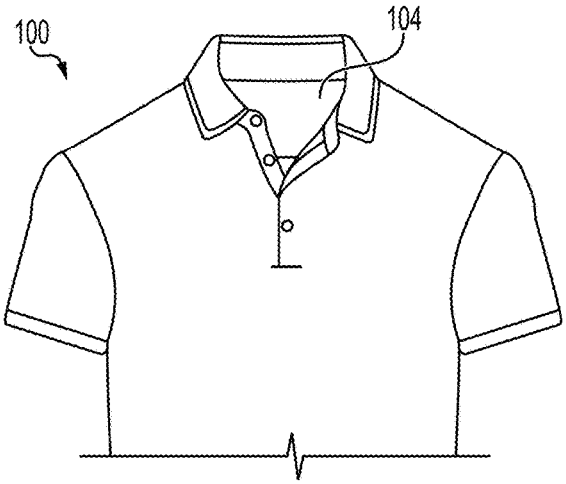
FIGS. 7A-13B illustrate exemplary embodiments of exemplary garments.
Figure 7B:
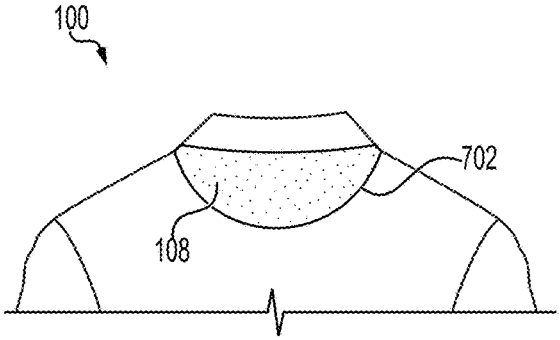

FIGS. 7A and 7B illustrate exemplary garment 100 having a panel 702 that would rest against the rear of the neck formed from a fabric having first layer 104, second layer 106, and third layer 108. In this embodiment, the first layer 104 of panel 702 is in contact with the rear of the neck of the wearer (below the collar). The third layer 108 is exposed to the environment on the exterior of the shirt. In the depicted embodiment, the panel 702 has a half moon shaped. The third layer 108 may comprise vent pores on third layer 108. In some embodiments, vent pores may also be added to first layer 104 and second layer 106.

Figure 8A:
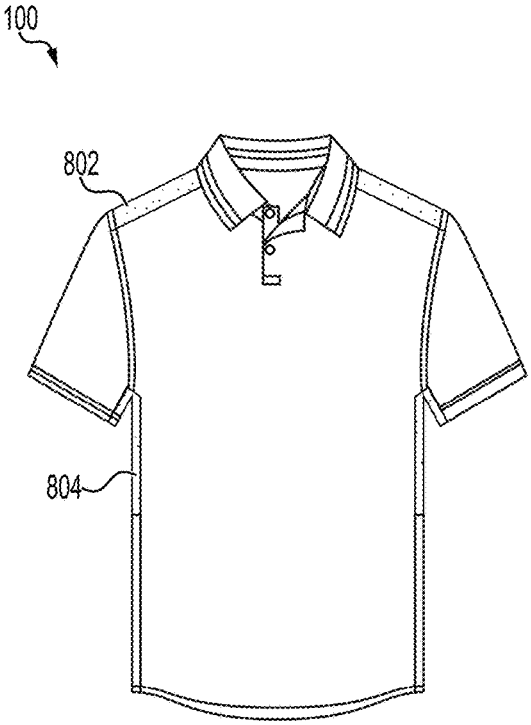
Figure 8B:
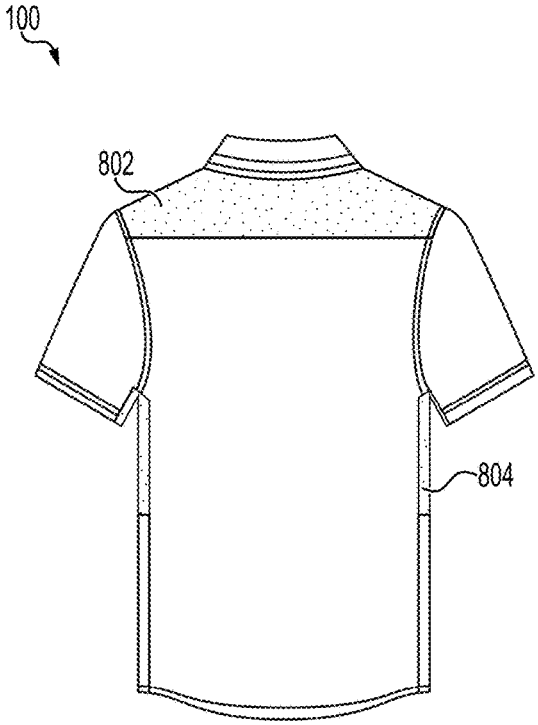

FIGS. 8A and 8B illustrate an exemplary garment 100 having yoke panel 802 and side panels 804. In this embodiment, the yoke is formed from yoke panel 802 in which the first layer 104 is against the skin of the wearer and the third layer 108 is exposed to the environment. Additionally, garment 100 may comprise one or more side panels 804. The side panels 804 may be placed along the sides of garments 100 or may extend from the side of the garment to the bottom of the sleeves to form under arm gussets. It should be obvious to one of ordinary skill in the art that vent panels can be added to any portion of the garment 100 as needed.

The size of the vent pores in yoke panel 802 and/or side panels 804 can be the same or different. For example, the vent pores in yoke panel 802 may be larger or more numerous that hose in side panels 804. In some embodiments, the vent pores may also be made in first layer 104 of yoke panel 802 or under arm panels 804 or through all three layers 104, 106, and 108.

Figure 9:
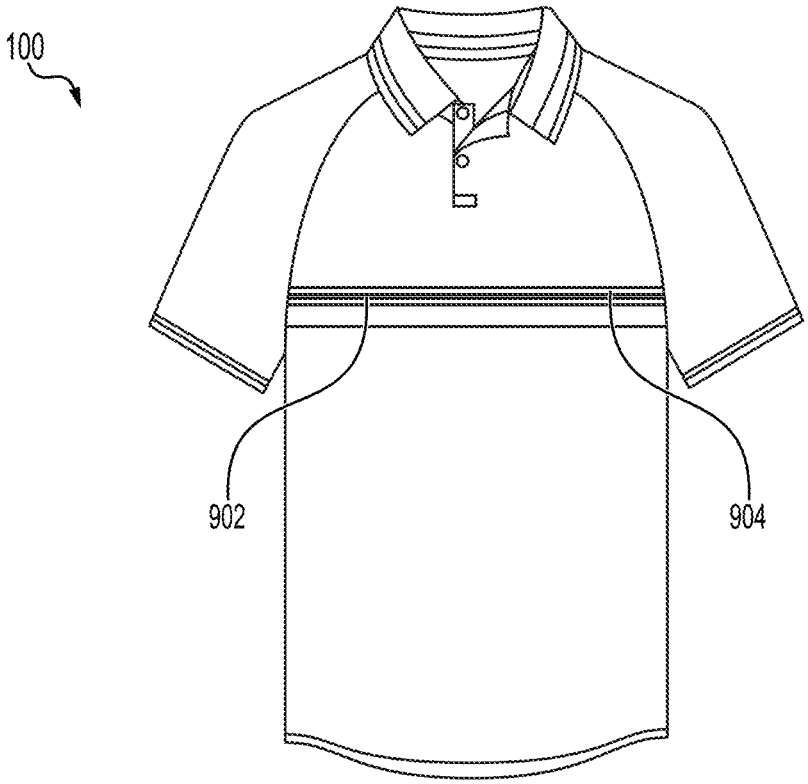

FIG. 9 depicts an exemplary garment 100 having one or more cooling channels 902 or cooling panels 904. The cooling channels 901 are preferably formed by a mesh fabric (e.g., a one-layer fabric) having a plurality of vent pores. The cooling panels 904 preferably have a first layer 104 that contacts the skin of the wearer and a third layer 108 that is exposed to the environment. Vent pores may be formed through the third layer 108 as has already been described or through all three layers 104, 106, and 108. The cooling channels 902 and cooling panels 904 can be placed anywhere on the garment 100 as needed. In the depicted example, the cooling channels 902 and cooling panels 904 are placed horizontally across the front of the garment 100.

Figure 10A:
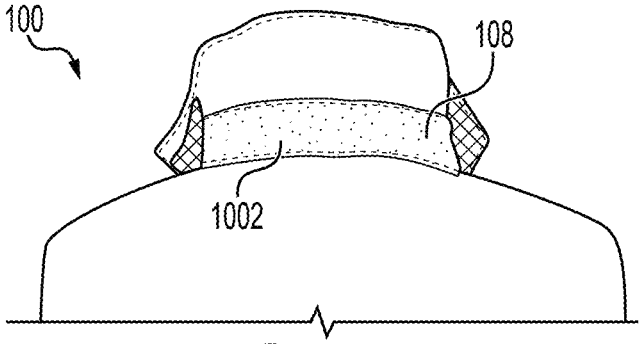
Figure 10B:
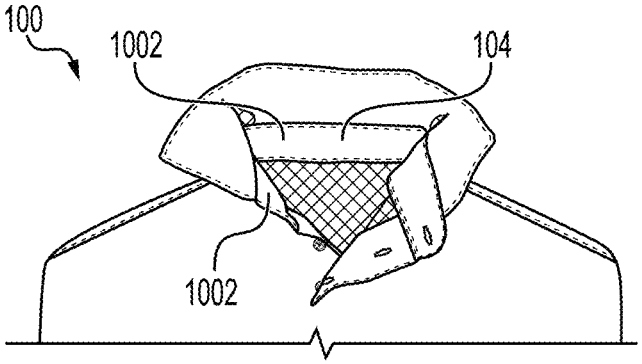

In some embodiments, a collar panel 1002 may be added to the collar 1004 of an exemplary garment 100 as depicted in FIGS. 10A and 10B. Here, the first layer 104 of the collar panel 1002 forms the lower part of collar 1004. The vent pores in third layer 108 are not visible when the outer layer of collar 1004 is folded down. The first layer 104 of collar panel 1002 rests against the skin of the wearer and helps to aid in cooling the wearer.

Figure 11B:
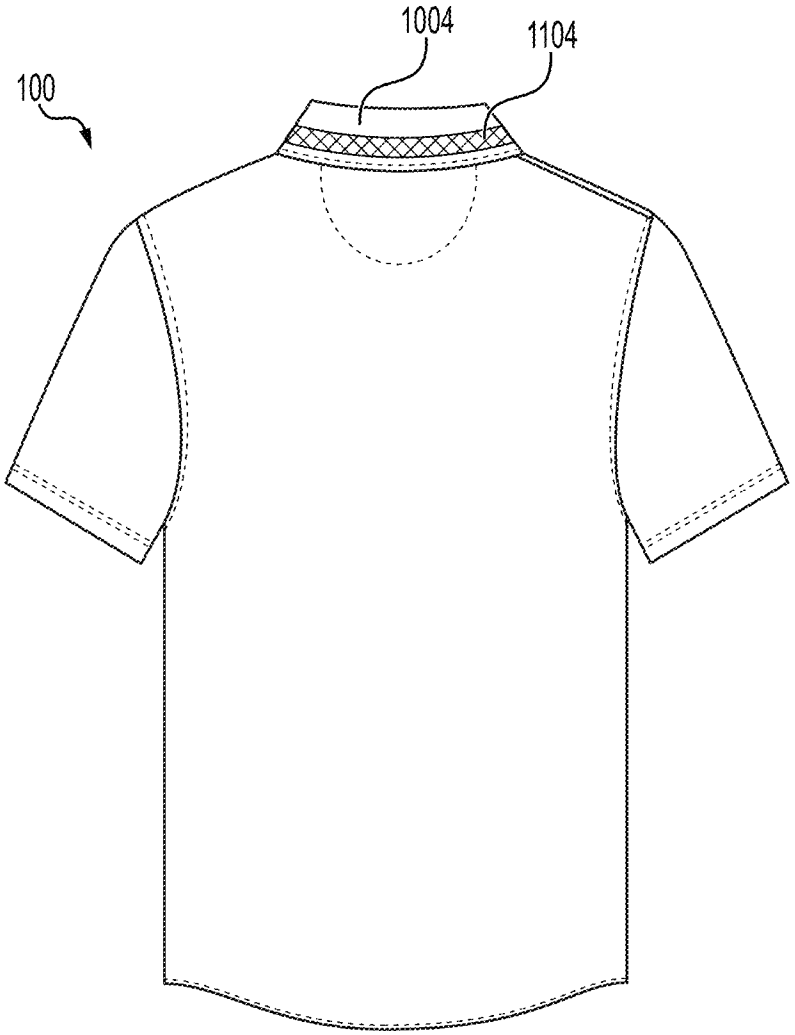
Figure 11A:
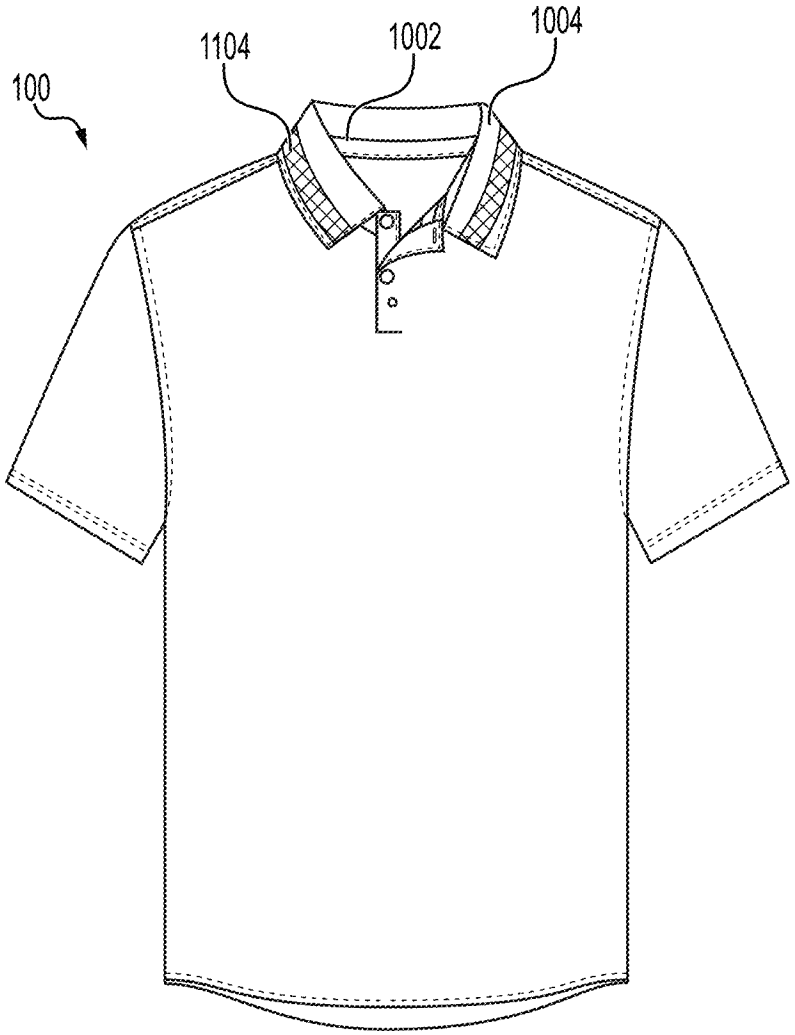

To help with cooling of collar panel 1002, vent pores 1104 may be added to the part of collar 1004 that folds down over third layer 108 of collar panel 1002. As depicted in FIGS. 11A and 11B, a plurality of vent pores 1104 may be added through the entirety of the collar 1004 or just through an exterior layer. In a preferred embodiment, the vent pores 1104 at least partially or wholly overlap with collar panel 1002 to maximize cooling. Since vent pores 1104 are visible while garment 100 is being worn, they may be arranged in a design or pattern that is aesthetically pleasing to a wearer or viewer of the garment.

Figure 12:
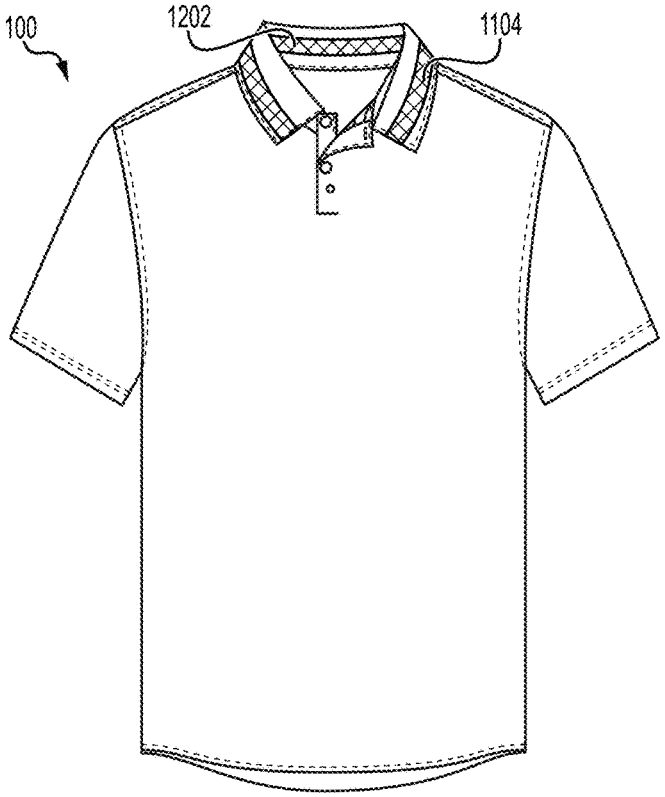

FIG. 12 depicts an exemplary garment 100 in which additional vent pores 1202 have been added to an interior of collar 1004 or collar panel 1002. The additional vent pores 1202 may extend around an entirety of the interior of collar 1004 or just along a portion of collar 1004.

Figure 13A:
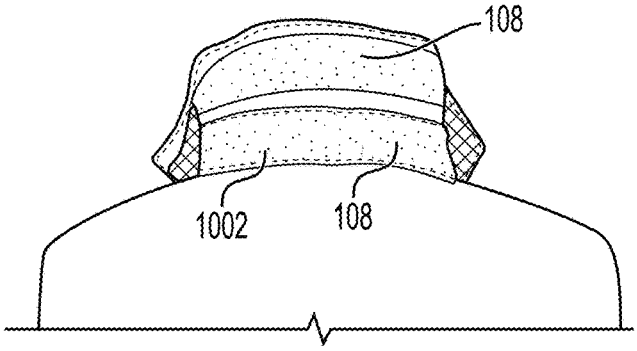
Figure 13B:
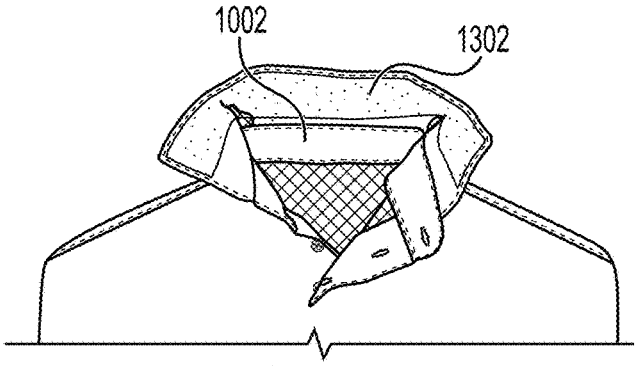

FIGS. 13A and 13B depict an exemplary garment 100 in which additional vent pores 1302 are added to the first layer 104 and third layer 108 in the folded down portion of collar 1004. The entirety of collar 1004 may be formed from the same fabric and additional vent pores 1302 can be added to any portion of collar 1004, first layer 104, second layer 106, and third layer 108.

In the foregoing description, various features may be grouped together in a single embodiment for purposes of streamlining the disclosure. This method of disclosure is not to be interpreted as reflecting an intention that the claims require more features than are expressly recited in each claim. Rather, as the following claims reflect, inventive aspects lie in less than all features of a single foregoing disclosed embodiment. Thus, the following claims are hereby incorporated herein, with each claim standing on its own as a separate embodiment of this disclosure.

Moreover, it will be apparent to those skilled in the art from consideration of the specification and practice of the present disclosure that various modifications and variations can be made to the disclosed systems without departing from the scope of the disclosure, as claimed. Thus, it is intended that the specification and examples be considered as exemplary only, with a true scope of the present disclosure being indicated by the following claims and their equivalents.

The invention claimed is:

1. A garment comprising:

a garment body; and a collar coupled to the garment body, wherein the collar comprises:

a first section adjacent to a skin of the wearer, and;

a second section configured to be folded down over the first section, wherein the first section comprises a first vent panel comprising:

a first layer, wherein the first layer includes a plurality of synthetic filament yarn with a modified cross-section;

a second layer, wherein the second layer includes another plurality of synthetic filament yarn in a mesh construction; and a third layer, wherein the third layer includes a first plurality of perforated holes, wherein the first plurality of perforated holes is formed by laser cutting, and wherein the first plurality of perforated holes pores having a diameter of 0.5 mm to 15 mm.

2. The garment to claim 1, wherein the first plurality of perforated holes is arranged in a first predetermined pattern.

3. The garment according to claim 2, wherein the first predetermined pattern is a logo or text.

4. The garment according to claim 2, wherein the first layer comprises a second plurality of perforated holes.

5. The garment according to claim 4, wherein the second plurality of perforated holes are arranged in a second predetermined pattern different than the first predetermined pattern.

6. The garment according to claim 4, wherein the first predetermined pattern is aligned with the second predetermined pattern.

7. The garment according to claim 4, wherein the second layer comprises a third plurality of perforated holes.

8. The garment according to claim 7, wherein at least some of the third plurality of perforated holes do not align with the first plurality of perforated holes.

9. The garment according to claim 1, wherein the second section comprises:

a second vent panel configured to at least partially overlap the first vent panel when the collar is folded down.

10. The garment according to claim 9, wherein the second vent panel comprises:

a second plurality of perforated holes.

11. The garment according to claim 10, wherein the second plurality of perforated holes partially overlap with the first plurality of perforated holes.

12. The garment according to claim 10, wherein the second plurality of perforated holes extend through all layers of the second vent panel.

13. The garment according to claim 10, wherein the second plurality of perforated holes circumscribe an entirety of the second section.

14. The garment according to claim 1, wherein the garment body comprises:

at least one body panel having a same construction as the first section.

* * * * *